US009474354B2

(12) United States Patent
Ponx

(10) Patent No.: US 9,474,354 B2
(45) **Date of Patent: *Oct. 25, 2016**

(54) BEACH/POOL BAG AND BACKPACK WITH HIDDEN COMPARTMENT

(71) Applicant: David A. Ponx, Pueblo (CO)

(72) Inventor: David A. Ponx, Pueblo (CO)

( * ) Notice: Subject to any disclaimer, the term of this patent is extended or adjusted under 35 U.S.C. 154(b) by 356 days.

This patent is subject to a terminal disclaimer.

(21) Appl. No.: 14/262,625

(22) Filed: Apr. 25, 2014

(65) Prior Publication Data

US 2015/0182007 A1 Jul. 2, 2015

Related U.S. Application Data

(63) Continuation-in-part of application No. 14/145,388, filed on Dec. 31, 2013.

(51) Int. Cl.

| | |
|---|---|
| ***B65D 33/02*** | (2006.01) |
| ***A45F 3/04*** | (2006.01) |
| ***A45C 3/10*** | (2006.01) |
| ***A45C 13/02*** | (2006.01) |
| *A45C 13/10* | (2006.01) |

(52) U.S. Cl.

CPC . *A45F 3/04* (2013.01); *A45C 3/10* (2013.01); *A45C 13/02* (2013.01); *A45C 13/103* (2013.01)

(58) Field of Classification Search

CPC ..... A45C 3/06; A45C 3/00; A45C 13/06; A45C 13/08; A45C 13/10

USPC ..... 150/118, 106, 103, 152, 113, 100, 101; 190/100, 103, 107, 108, 111, 112; 206/549, 579; 383/24, 38, 39, 40, 76; 224/257

See application file for complete search history.

(56) References Cited

U.S. PATENT DOCUMENTS

| | | | | |
|---|---|---|---|---|
| 3,759,356 | A * | 9/1973 | Bostick | A45C 7/00 190/111 |
| 4,756,394 | A * | 7/1988 | Cohen | A45C 5/14 150/111 |
| 4,941,603 | A * | 7/1990 | Creamer | A45F 3/04 150/109 |
| 5,748,089 | A * | 5/1998 | Sizemore | G08B 21/0297 340/568.7 |
| 6,000,509 | A * | 12/1999 | Chisholm | A45C 13/02 150/113 |
| 6,231,268 | B1 * | 5/2001 | Hausenbauer | B01F 7/00733 366/285 |
| 6,253,570 | B1 * | 7/2001 | Lustig | A45C 15/00 62/125 |
| 2004/0108179 | A1 * | 6/2004 | Scicluna | A45C 5/06 190/109 |
| 2005/0098598 | A1 | 5/2005 | Kuhn | |
| 2009/0140020 | A1 * | 6/2009 | Schlipper | A45C 13/30 224/257 |
| 2012/0125494 | A1 * | 5/2012 | Avganim | A45C 13/20 150/101 |

OTHER PUBLICATIONS

*Pacsafe Z-28Anti-Theft Urban Security Backpack* L.L. Bean website.

"*OGIO Freezer Cooler*" The Pink Monogram Website.

* cited by examiner

*Primary Examiner* — Fenn Mathew

*Assistant Examiner* — Cynthia Collado

(74) *Attorney, Agent, or Firm* — Richard C. Litman

(57) ABSTRACT

The beach/pool bag with hidden compartment has a hidden compartment positioned at the bottom of the bag that is equipped with a zipper-closable access. A flap is provided to cover and conceal the zipper, thereby presenting a false bottom and disguising the existence of the compartment underneath. The backpack with hidden compartment is similar to the beach/pool bag, but has shoulder straps instead of handles. A cable and lock are provided to secure the backpack to a stationary object if the backpack is to be laid aside.

10 Claims, 9 Drawing Sheets

BEACH/POOL BAG AND BACKPACK WITH HIDDEN COMPARTMENT

CROSS-REFERENCE TO RELATED APPLICATION

This application is a continuation-in-part of U.S. patent application Ser. No. 14/145,388, filed on Dec. 31, 2013.

BACKGROUND OF THE INVENTION

1. Field of the Invention

The present invention generally relates to receptacles, and particularly to a beach/pool bag with a hidden compartment located therein, and also to a backpack with a hidden compartment located therein.

2. Description of the Related Art

Spending fun time at the swimming pool or beach often requires the need for a plethora of ancillary items. Sunblock, comb, brush, extra pool/beach apparel, towels, first aid kit, etc. are just some of the items that are usually transported to the selected venue. The ubiquitous beach bag is the popular receptacle of choice to transport and house the array of above-mentioned items. Aside from the usual items, the beach bag may also be employed to transport refreshing beverages and house valuables, such as cash, jewelry and personal identification items (driver's license, medical insurance cards, etc.). However, keeping the beverages hot or cold and the valuables hidden from sight presents a problem for the beach bag user. A beach bag that could serve as a repository for the usual beach/pool paraphernalia and also provide a hidden insulated compartment for housing beverages and/or valuables would certainly be a welcome asset to a user.

Also, whether going to school, hiking, going to the playground, or just spending time outdoors with friends in any venue, there is often a need to transport a plethora of items. Text books, notebooks, extra wearing apparel, etc. are just some of the items that are usually transported to the selected venue. The ubiquitous backpack is the popular receptacle of choice to transport and house the array of above-mentioned items. Aside from the usual items, the backpack may also be employed to transport refreshing beverages and house valuables, such as cash, jewelry and personal identification items (driver's license, medical insurance cards, etc.). However, keeping the beverages hot or cold and the valuables hidden from sight presents a problem for the backpack user. A backpack that could serve as a repository for the usual backpack paraphernalia and also provide a hidden insulated compartment for housing beverages and/or valuables would certainly be a welcome asset to a user. Thus, a beach/pool bag with a hidden compartment and a backpack with a hidden compartment solving the aforementioned problems are desired.

SUMMARY OF THE INVENTION

The beach/pool bag with hidden compartment is a beach or pool bag having a compartment positioned at the bottom of the bag, the compartment having a zipper-closable access. A flap is provided to cover and conceal the zipper, thereby presenting a false bottom and disguising the existence of a compartment underneath. A hidden zipper-closable access to the compartment is also provided on the exterior surface of the bag.

Similar to the beach/pool bag, the backpack with hidden compartment has a compartment positioned at the bottom of the backpack, the compartment having a zipper-closable access. A flap is provided to cover and conceal the zipper, thereby presenting a false bottom and disguising the existence of a compartment underneath. A hidden zipper-closable access to the compartment is also provided on the exterior surface of the backpack. Means are provided to secure the backpack to a stationary object if the backpack is to be laid aside.

Accordingly, the invention presents a beach bag having a conventional appearance, but incorporating a hidden compartment therein. The compartment is insulated and can be utilized to conceal personal valuables therein and to also house beverage containers. The bag also includes a cable for attaching the bag to a stationary object.

In addition, the invention presents a backpack having a conventional appearance, but incorporating a hidden compartment therein. The compartment is insulated and can be utilized to conceal personal valuables therein and to also house beverage containers. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
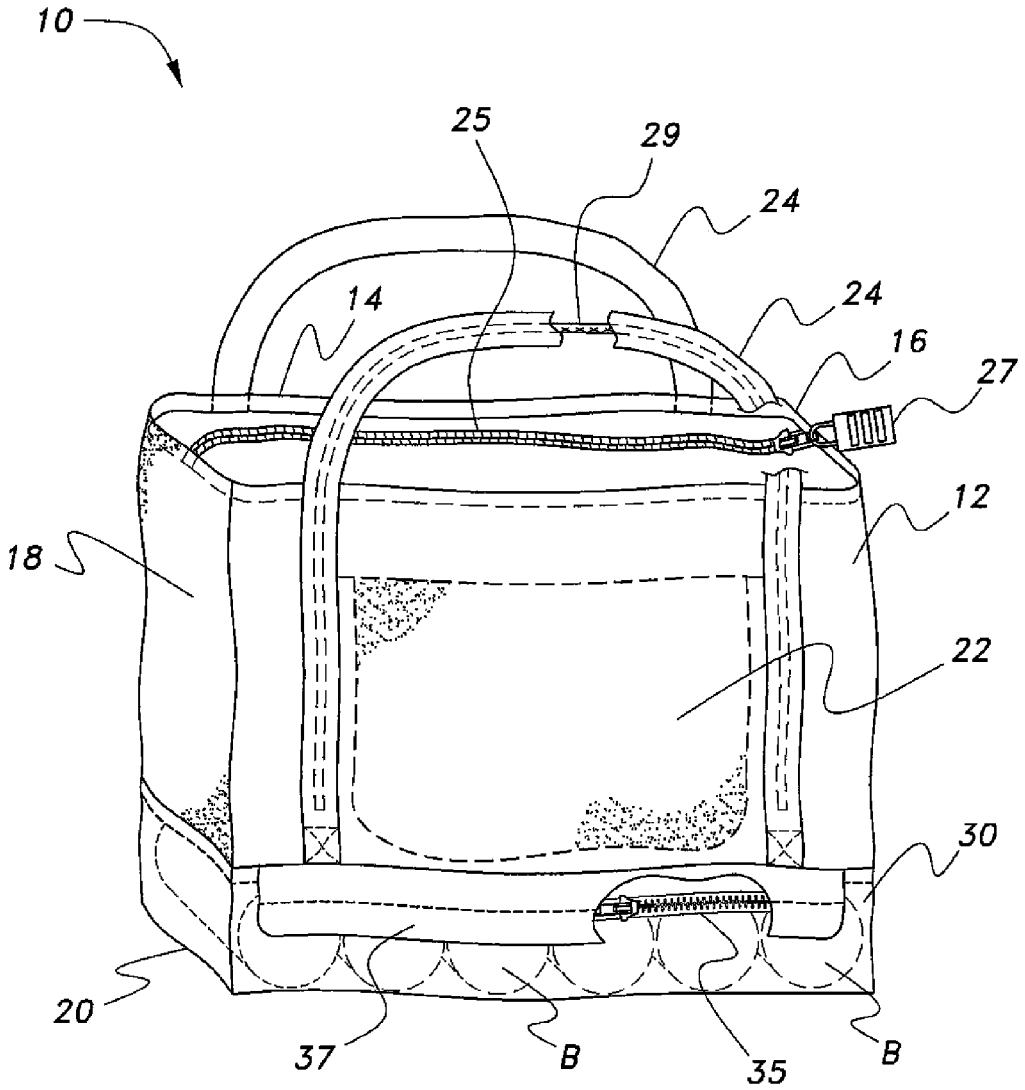
FIG. 1 is a perspective view of a beach/pool bag with hidden compartment according to the present invention.
Figure 2:
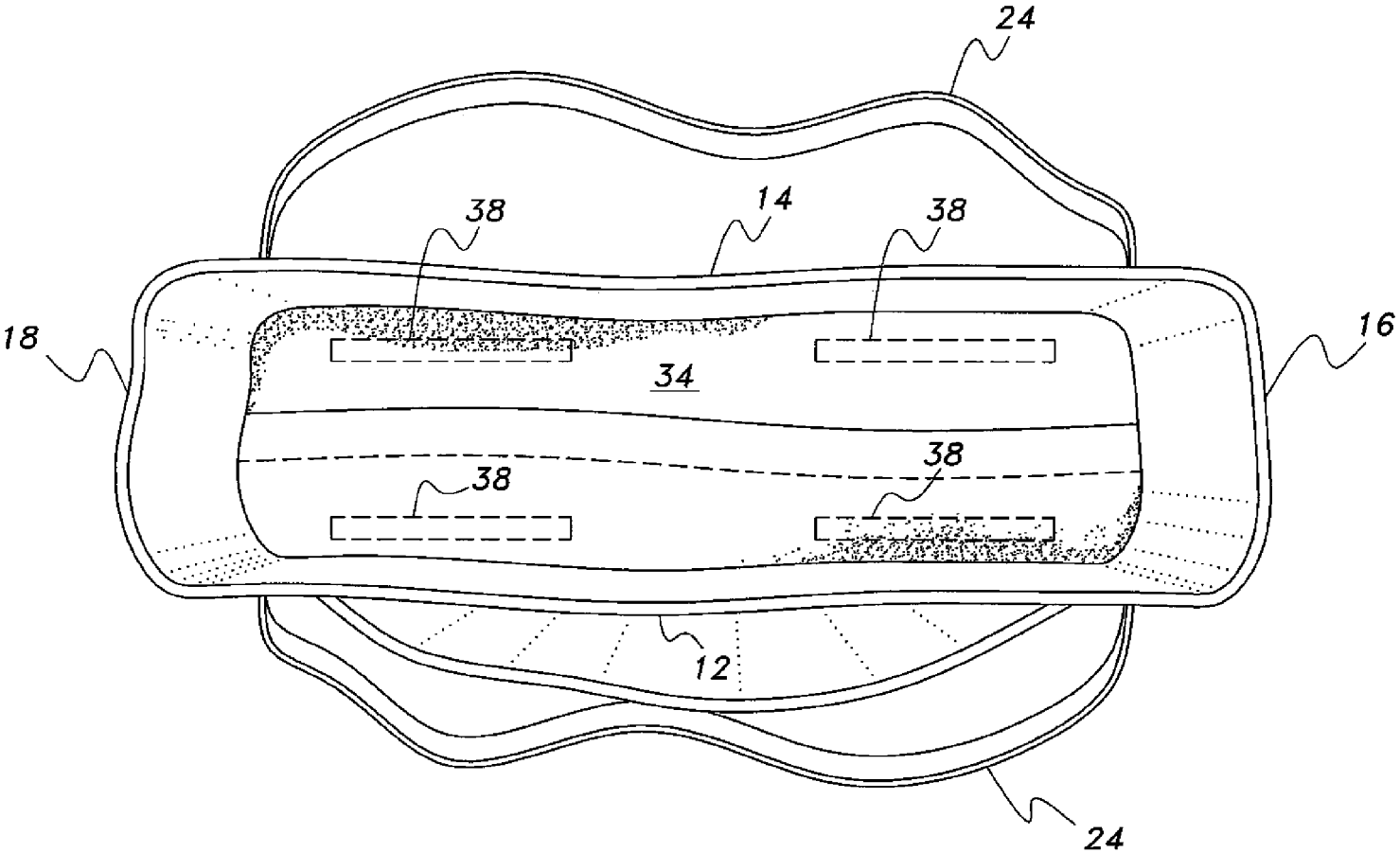
FIG. 2 is a top view of the beach/pool bag of FIG. 1, showing the inside of the bag with the zipper access to the hidden compartment closed and hidden from view.
Figure 3:
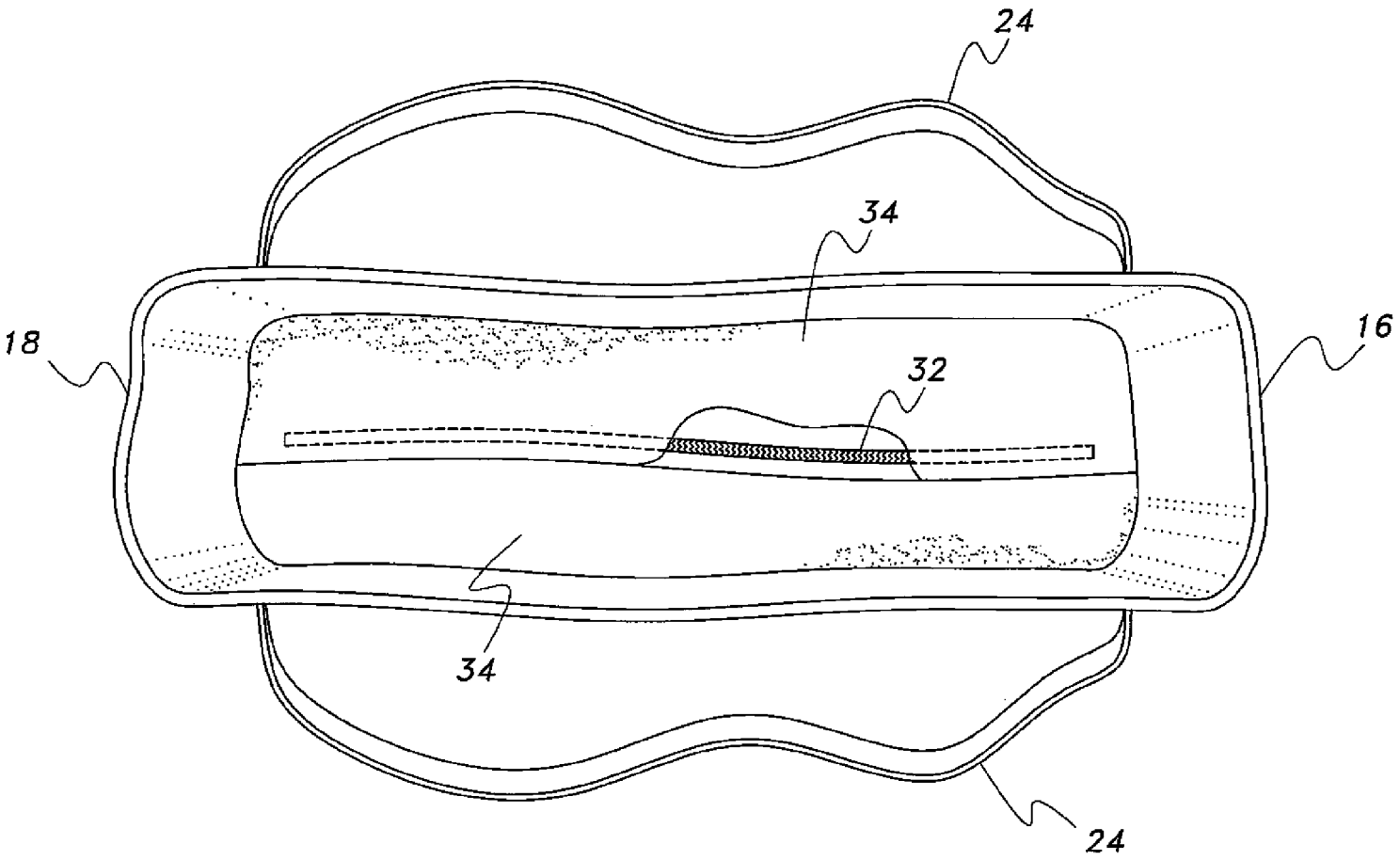
FIG. 3 is a top view of the beach/pool bag of FIG. 2, with a portion of the flap member broken away to show the zipper access to the hidden compartment.
Figure 4:
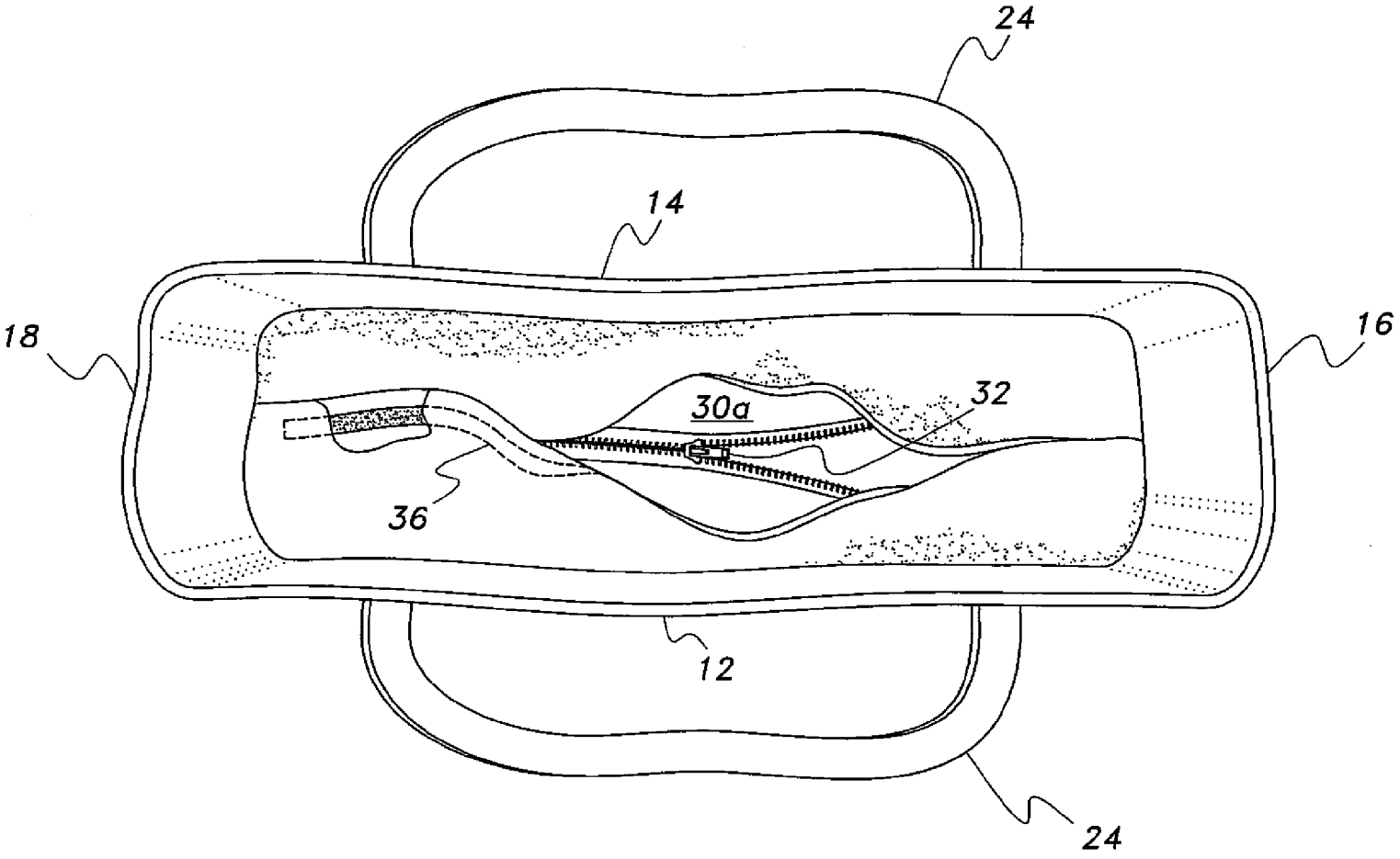
FIG. 4 is a top view of the beach/pool bag of FIG. 3, showing the hidden compartment partially open.

Referring to FIGS. 1-4, the beach/pool bag with hidden compartment is generally indicated at 10. The bag 10 conventionally comprises respective front and rear walls 12, 14, sidewalls 16, 18 and bottom wall 20 attached at their edges to form an open-top first compartment. Optionally, the stiff sidewalls 16, 18 could be eliminated to leave a flexible upper portion of the bag 10 if it is desired to conserve material. One or more pouches 22 (only one is shown) are positioned on the exterior surfaces of the front and rear walls 12, 14 to house items therein. Although not illustrated, additional pouches could be provided for the exterior surfaces of the sidewalls 16, 18, if desired. Carrying straps 24 or a drawstring are attached to the bag 10 in a suitable manner. A zipper 25 is employed to close the open top of the bag. The zipper may be secured with a lock 27. The lock may take the form of a built in type and/or combination type if desired. The walls of the bag 10 may be fabricated from any suitable material (canvas, leather, nylon, vinyl, etc.). A security cable 29 having a lock thereon (not shown) is hidden inside one of the carrying straps 24 and is removable therefrom. The security cable 29 provides a means to attach the bag 10 to a stationary object, such as a beach chair or the like, to prevent easy theft of the bag 10. The cable 29 may be fabricated from any suitable material that is flexible and not easily broken or cut.

A second compartment 30 is positioned at the bottom of bag 10. The second compartment 30 is fabricated from thermal insulation material or incorporates thermal insulation into the walls and is dimensioned to house several conventional beverage containers B therein. The second compartment 30 has a top surface 30*a* fashioned with an opening that is closed with a zipper 32. A movable flap 34 is designed to overlie the top surface 30*a* of the compartment 30 for reasons explained below. One side of the flap 34 is permanently attached to the top surface 30*a*. Hook and loop fasteners 36 are employed to removably attach the other side of the flap 34 to the top surface 30*a* of the compartment 30. With the flap 34 in place, anyone unfamiliar with the bag 10 would assume that the flap 34 is the inside bottom wall of the bag 10, and thus be unaware that a compartment exists beneath the flap 34. The compartment 30 may also be accessed from the exterior of bag 10. This is accomplished by providing an opening on at least one exterior side surface of the bag 10 to access the compartment 30. A zipper 35 is operable to open and close the opening. The zipper 35 is covered by a movable flap 37, similar to flap 34, which hides the zipper 35 from view. Stiffener or reinforcement members 38 (shown in phantom lines and preferably fabricated from hard plastic) are removably inserted in the compartment 30 along the walls and bottom thereof for extra support, and to allow the bag 10 to stand upright when the compartment 30 is not filled with beverage containers B, thereby maintaining the illusion of a bag 10 having no additional compartment at its bottom.

In use, the compartment 30 is unzipped and the desired items are inserted therein. As indicated above, the items may be beverage containers B that are to be kept at a cool temperature range, or personal valuables. The zipper 32 (or 35) is manipulated to close the compartment 30. The flaps 34 and/or 37 are arranged over the compartment 30 and attached thereto, thereby concealing the compartment 30 from view.

Figure 5:
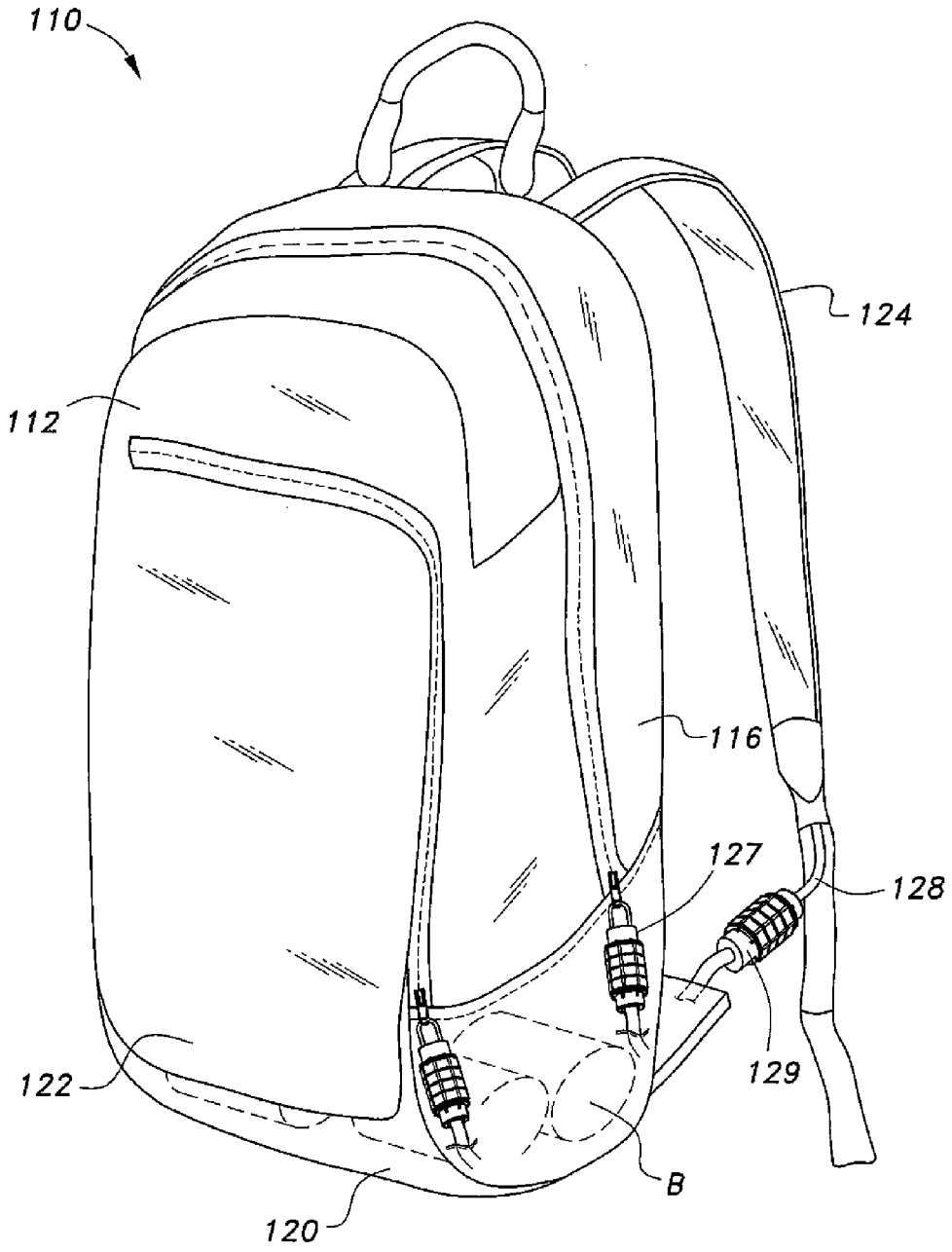
FIG. 5 is a front, perspective view of a backpack with hidden compartment according to the present invention.
Figure 6:
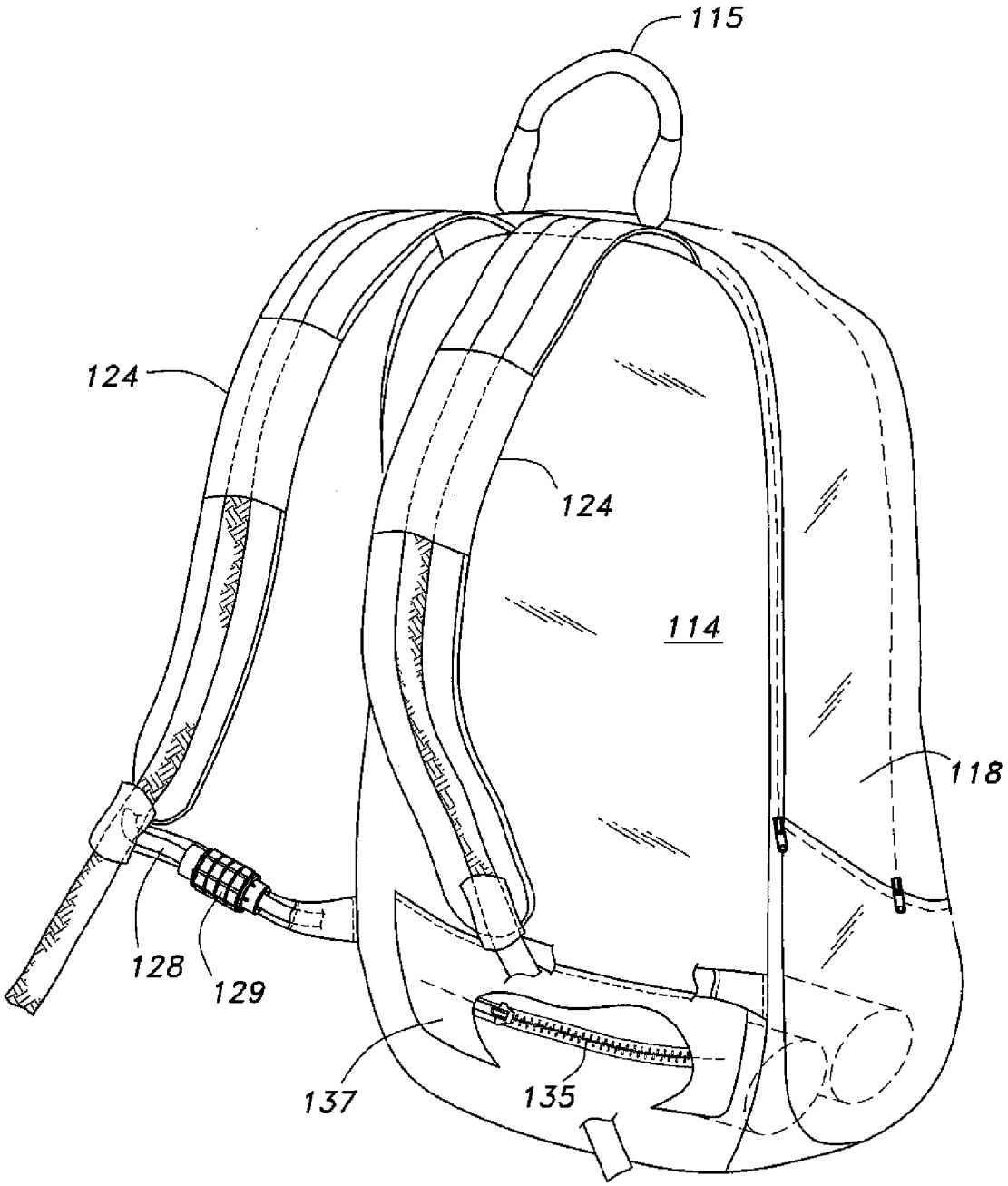
FIG. 6 is a rear, perspective view of the backpack with hidden compartment according to the present invention.
Figure 7:
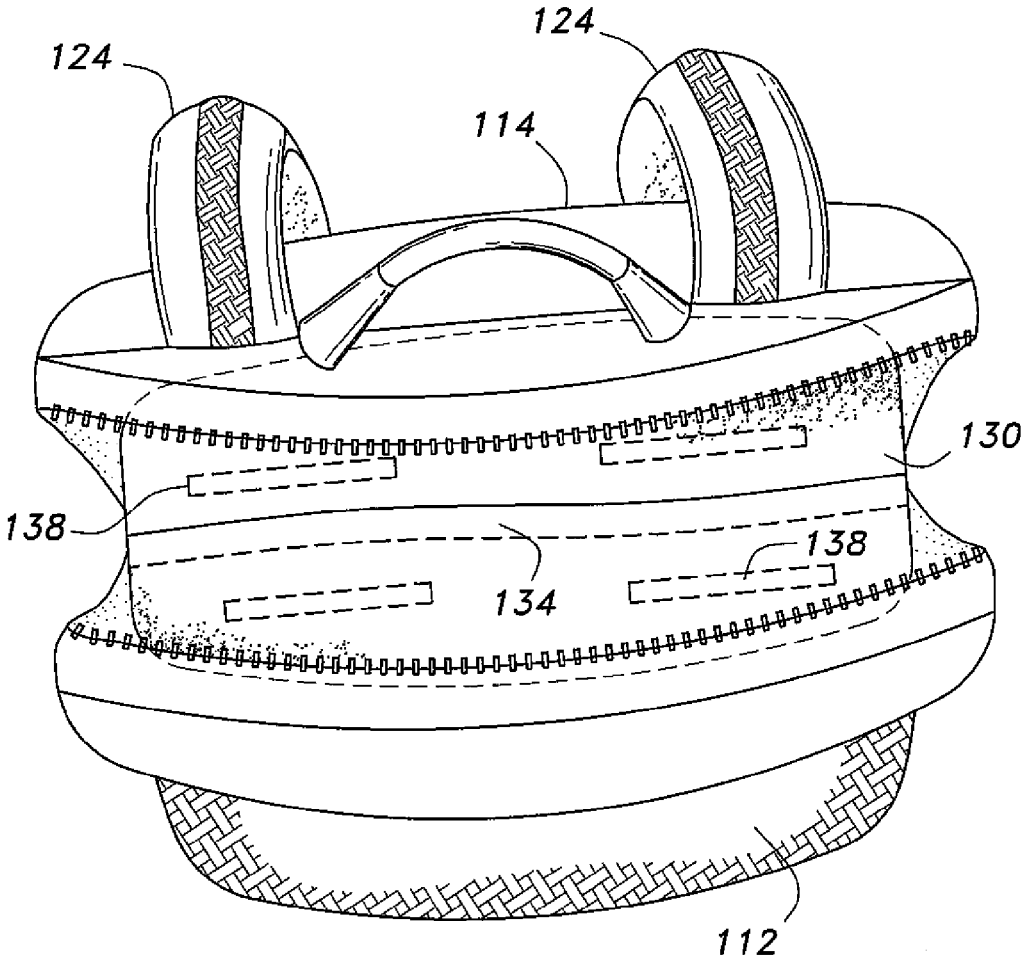
FIG. 7 is a top view of the backpack of FIG. 5, showing the inside of the backpack with the zipper access to the hidden compartment closed and hidden from view.
Figure 8:
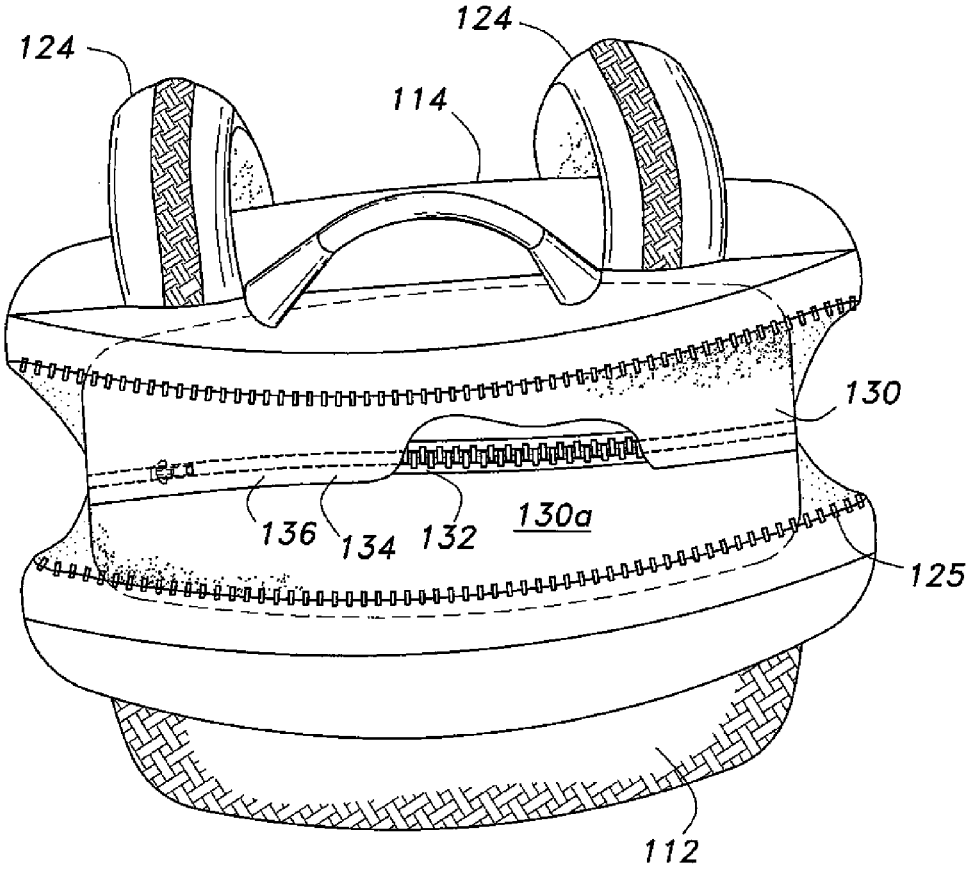
FIG. 8 is a top view of the backpack of FIG. 5, showing the inside of the backpack with a portion of the flap broken away to show the zipper access to the hidden compartment view.
Figure 9:
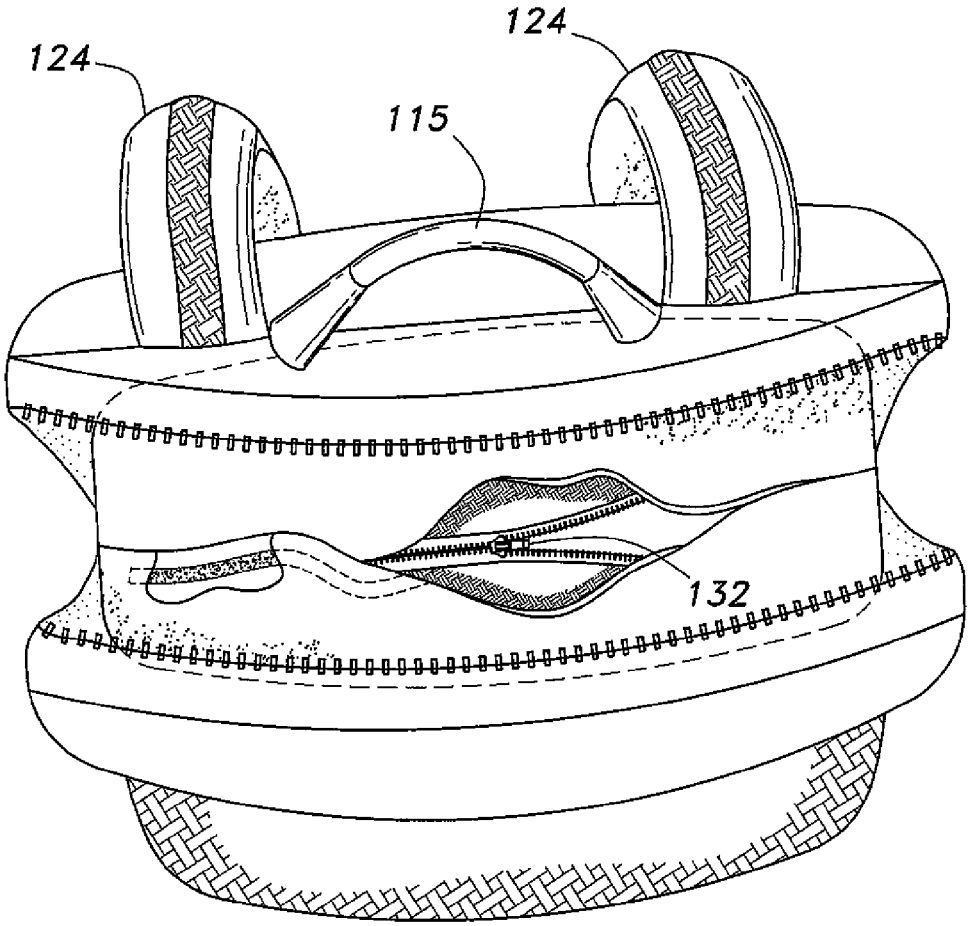
FIG. 9 is a top view of the backpack of FIG. 5, showing the inside of the backpack with the hidden compartment partially open.

Referring to FIGS. 5-9, the backpack with hidden compartment is generally indicated at 110. The backpack 110 comprises respective front and rear walls 112, 114, sidewalls 116, 118 and bottom wall 120 attached at their edges to form an open-top first compartment. One or more pouches 122 (only one is shown) are positioned on the exterior surfaces of the front and/or rear walls 112, 114 to house items therein. Although not illustrated, additional pouches could be provided for the exterior surfaces of the sidewalls 116, 118, if desired. Shoulder carrying straps 124 are attached to the bag 110 adjacent rear surface 114 in a suitable manner. A handle member 115 is provided to carry the backpack by hand, if desired. A zipper 125 is employed to close the open top of the bag. The zipper 125 may be secured with a lock 127. The lock 127 may take on other forms and may be applied to as many zippered openings as desired. The walls of the bag 110 may be fabricated from any suitable material (canvas, leather, nylon, vinyl, etc.). At least one of the shoulder straps 124 includes a reinforcement cable 128 hidden therein. The cable 128 is secured to the backpack 110 by means of a combination lock 129. This arrangement permits the lock 129 to be opened so that the end of the strap 124 can be detached from the backpack 110. The strap 124 may then be wrapped around a stationary object, and the end may be relocked to the backpack 110, thereby securing the backpack 110 to the stationary object to prevent easy theft of the backpack 110.

A second compartment 130 is positioned at the bottom of backpack 110. The second compartment 130 is fabricated from thermal insulation material or incorporates thermal insulation into the walls, and is dimensioned to house several conventional beverage containers B therein. The second compartment 130 has a top surface 130*a* fashioned with an opening that is closed with a zipper 132. A movable flap 134 is designed to overlie the top surface 130*a* of the compartment 130 for reasons explained below. One side of the flap 134 is permanently attached to the top surface 130*a*. Hook and loop fasteners 136 are employed to removably attach the other side of the flap 134 to the top surface 130*a* of the compartment 130. With the flap 134 in place, anyone unfamiliar with the backpack 110 would assume that the flap 134 is the inside bottom wall of the backpack 110, and thus be unaware that a compartment exists beneath the flap 134. The compartment 130 may also be accessed from the exterior of bag 110. This is accomplished by providing an opening on at least one exterior side surface of the backpack 110 to access the compartment 130. A zipper 135 is operable to open and close the opening. The zipper 135 is covered by a movable flap 137, similar to flap 134, which hides the zipper 135 from view. Stiffener or reinforcement members 138 (shown in phantom lines and preferably fabricated from hard plastic) are removably inserted in the compartment 130 along the walls and bottom thereof for extra support, and to allow the backpack 110 to stand upright when the compartment 130 is not filled with beverage containers B, thereby maintaining the illusion of a bag 110 having no additional compartment at its bottom.

In use, the compartment 130 is unzipped and the desired items are inserted therein. As indicated above, the items may be beverage containers B that are to be kept at a cool temperature range, or personal valuables. The zipper 132 (or 135) is manipulated to close the compartment 130. The flaps 134 and/or 137 are arranged over the compartment 130 and attached thereto, thereby concealing the compartment 130 from view.

It is to be understood that the present invention is not limited to the embodiments described above, but encompasses any and all embodiments within the scope of the following claims.

I claim:

1. A backpack with hidden compartment, comprising:

a front wall, a rear wall, a pair of sidewalls and a bottom wall joined together to form a first compartment having an open top;

a second compartment disposed within the first compartment, the second compartment having a top surface, the top surface having an opening defined therein providing access to the second compartment;

a first zipper mounted to the top surface for selectively opening and closing the opening;

a first movable flap member mounted on the top surface for optionally overlaying the to zipper and hiding the opening to the second compartment;

a pair of shoulder straps attached to the rear wall; and a reinforcement cable hidden within one of the shoulder straps, the cable having an end removably attached to the rear wall of the first compartment.

2. The backpack according to claim 1, further including a lock attached to the end of said cable for removably attaching the cable to the rear wall of said first compartment.

3. The backpack according to claim 1, further including a fastener for optionally closing the open top of said first compartment.

4. The backpack according to claim 1, further including at least one pouch attached to one of the walls of said first compartment.

5. The backpack according to claim 1, wherein said second compartment is thermally insulated.

6. The backpack according to claim 1, wherein said second compartment has an external side surface having an opening therein providing access to said second compartment, said second compartment further comprising;

a second zipper mounted in the side surface for selectively opening and closing the opening in the external side surface; and a second movable flap member mounted on the external side surface for selectively overlaying the second zipper and hiding the opening in the external side surface.

7. A backpack with hidden compartment, comprising:

a front wall, a rear wall, a pair of sidewalls and a bottom wall joined together to form a first compartment having an open top;

a thermally insulated second compartment disposed within the first compartment, the second compartment having a top surface, the top surface having an opening defined therein providing access to the second compartment;

a first zipper mounted to the top surface for selectively opening and closing the opening;

a first movable flap member mounted on the top surface for optionally overlaying the zipper and hiding the opening to the second compartment;

a pair of shoulder straps attached to the rear wall;

a reinforcement cable hidden within one of the shoulder straps the cable having an end removably attached to the rear wall of the backpack; and a lock member attached to the end of the cable for removably attaching the cable to the rear wall of the backpack.

8. The backpack according to claim 7, further including a fastener for optionally closing the open top of said first compartment.

9. The backpack according to claim 7, wherein said second compartment has an external side surface having an opening therein providing access to said second compartment, said second compartment further comprising;

a second zipper mounted in the side surface for selectively opening and closing the opening in the external side surface; and a second movable flap member mounted on the external side surface for selectively overlaying the second zipper and hiding the opening in the external side surface.

10. The backpack according to claim 9, further including at least one pouch attached to one of the walls of said first compartment.

* * * * *